US007225572B2

(12) United States Patent
Lowry

(10) Patent No.: US 7,225,572 B2
(45) Date of Patent: Jun. 5, 2007

(54) LABEL/SIGN HOLDER WITH J-STRIP SUPPORT SURFACE MOUNT

(75) Inventor: Michael G. Lowry, Boca Raton, FL (US)

(73) Assignee: Fast Industries, Ltd, Fort Lauderdale, FL (US)

( * ) Notice: Subject to any disclaimer, the term of this patent is extended or adjusted under 35 U.S.C. 154(b) by 276 days.

(21) Appl. No.: 11/064,505

(22) Filed: Feb. 24, 2005

(65) Prior Publication Data

US 2005/0188574 A1 Sep. 1, 2005

Related U.S. Application Data

(60) Provisional application No. 60/547,879, filed on Feb. 27, 2004.

(51) Int. Cl.
*G09F 3/18* (2006.01)

(52) U.S. Cl. ..... 40/649; 40/661.03

(58) Field of Classification Search ..... 40/661.03, 40/649; 211/119.003, 90.01, 59.2; 248/220.21
See application file for complete search history.

(56) References Cited

U.S. PATENT DOCUMENTS 3,555,712 A * 1/1971 Yargeau ..... 40/649
4,485,575 A 12/1984 Fast
4,531,313 A 7/1985 Fast
4,625,441 A 12/1986 Fast
4,704,813 A 11/1987 Fast
4,713,899 A 12/1987 Fast
4,738,426 A * 4/1988 Bessinger ..... 248/250
4,917,342 A 4/1990 Fast
4,995,182 A 2/1991 Fast
5,458,307 A 10/1995 Gebka
5,488,793 A 2/1996 Gebka et al.
5,515,632 A 5/1996 Gebka et al.
5,682,698 A 11/1997 Bevins
5,899,011 A 5/1999 Brinkman
6,105,295 A 8/2000 Brinkman et al.
6,163,996 A 12/2000 Gebka
6,299,004 B1 * 10/2001 Thalenfeld et al. ..... 211/184
6,568,112 B2 5/2003 Lowry et al.
6,571,498 B1 * 6/2003 Cyrluk ..... 40/661.03
6,688,567 B2 * 2/2004 Fast et al. ..... 248/220.41
2004/0060883 A1 * 4/2004 Walker ..... 211/119.003
2004/0252470 A1 12/2004 Lowry et al.
2005/0139560 A1 * 6/2005 Whiteside et al. .... 211/119.003

* cited by examiner

*Primary Examiner*—Cassandra Davis
(74) *Attorney, Agent, or Firm*—Jacobson Holman PLLC

(57) ABSTRACT

An attachment structure for a label holder for removably securing the label holder to a supporting surface of a shelf or case. The attachment structure includes a J-strip member fixedly secured to the supporting surface to define a channel for receiving a locking strip that is integral with the label holder. The J-strip includes a flexible bead that engages the upper planar surface of the locking strip and includes an elongated slot that receives a flexible bead integral with the locking strip. The flexible bead of the locking strip engages the elongated slot within the J-strip to secure the locking strip, and its integral label holder, within the J-strip.

12 Claims, 4 Drawing Sheets

LABEL/SIGN HOLDER WITH J-STRIP SUPPORT SURFACE MOUNT

This is a complete application claiming benefit of provisional application Ser. No. 60/547,879 filed Feb. 27, 2004.

BACKGROUND OF THE INVENTION

1. Field of the Invention

This invention relates to merchandising aids, and relates more particularly to the manner and means by which a label holder including, in particular, an electronic shelf label (ESL) carrier, is easily and removably secured to a merchandising shelf, particularly a merchandising shelf associated with displays of meat, fish and egg products that are subject to frequent washing operations. For simplicity, the terms "label holder", "label/sign holder" and "label carrier" are used interchangeably to include label holders with or without one or more means to also carry a sign or flag and to also include ESL carriers that include an ESL holder (with or without a cover) and an ESL attachment member, as discussed below.

2. Description of the Related Art

Consumer-oriented product information labels are commonly found in supermarkets, drug stores, and the like and provide purchasers with the unit price, promotional and nutritional information, and the like and, also, commonly include bar codes or other inventory control information for the use of the store personnel. Such information may be carried on paper or plastic labels secured directly to the side of a shelf unit or the front edge of a merchandise shelf, but the use of adhesively-backed labels has obvious disadvantages in the constantly changing commercial environment found in today's marketplace. More often, plastic label holders are provided which are adapted to removably receive and display the labels in a well known manner.

Such label holders are generally provided in elongated sections, perhaps 4' or more in width, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in U.S. Pat. Nos. 4,713,899, 5,458,307, 5,488,793, 5,515,632, 5,682,698, 5,899,011 and 6,105,295, the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as U.S. Pat. Nos. 4,485,575, 4,531,313, 4,625,441, 4,704,813, 4,917,342, 4,995,182, 5,682,698, and 6,163,996, the disclosures of which are also incorporated herein in their entireties by reference.

Still further, combined label and sign holders are available, such as are disclosed in U.S. Pat. No. 6,568,112, the disclosure of which is incorporated by reference herein, and the OMNI™ channel system of Fast Industries which is available in embodiments that attach to C-channels or directly to a supporting surface by double-sided tape or similar adhesive.

More recently, in place of, or in addition to, such paper or plastic information containing labels, electronic information carriers have been employed. Electronic shelf labels (ESLs) are generally integrated with the in-store processor (ISP) or a free-standing controller that communicates with file information supporting the store's point-of-sale system. The ESL system may include low-voltage communication electronics or communication base stations (CBS) located in store ceilings away from the store operations. The ESLs are positioned throughout the store to identify an item's retail price and other information of interest to the consumer or for use by the store's inventory system. These ESL units, however, much like paper labels, require a carrier device to facilitate supporting them at selected locations, usually on the front of a store merchandise shelf. The ESL carrier may be of three components, the ESL holder, a cover for the holder (optional), and an attachment member that supports the ESL holder and attaches directly to a support surface of the merchandise shelf. See U.S. patent application Ser. No. 10/448,049 filed May 30, 2003 now U.S. Pat. No. 6,935,062, the disclosure of which is incorporated by reference herein.

Each of the above label holders, sign holders, combined label and sign holders, and ESL carriers may be attached or affixed to a supporting surface of a merchandising shelf through various arrangements. Generally, these arrangements might include a C-channel with which the attachment member of the label holder or carrier may be releasably secured. In situations where a C-channel is lacking, generally the attachment is made directly to a supporting surface of the merchandising shelf in a fixed manner, such as by adhesive or double-sided tape.

In grocery and warehouse stores that have packaged and prepared meat departments, FDA guidelines require a "hosing down" and cleaning of the meat cases on a periodic and frequent basis, such as weekly. Thus, all labels and signs have to be removed or run the risk of being damaged by water. Thus, a need exists to provide a system for protecting damage to the label holder, particularly where the label holder is an ESL carrier system where the electronic components can be damaged by water, in an efficient and inexpensive manner.

SUMMARY OF THE INVENTION

It is a primary object of the present invention to provide a means for facilitating attachment and detachment of a label holder, such as seen, for example, in U.S. Pat. No. 5,515,632, and/or a combination label/sign holder, such as seen in, for example, U.S. Pat. No. 6,568,112 and/or an ESL carrier, such as is shown in pending patent application Ser. No. 10/448,049, to a merchandising shelf or case particularly cases of the type used for carrying meat, fish, and egg products that are subject to frequent and periodic washing operations and which require removal of the labels and signs quickly and reliably.

Another object of the invention is to provide a label/sign holder or ESL carrier that includes an integrally-formed locking strip that is easily insertable and removable from a support surface mounted J-strip that includes a receiving channel to receive and secure the locking strip therewithin.

Still further, it is an object of the present invention to provide a quick and easy locking structure for removing and reattaching the label holder to the casing supporting surface without requiring separate attachment elements or assembly/disassembly steps.

Other and further objects, features, and advantages in the invention will become apparent from the ensuing description taken in conjunction with the attached drawings.

BRIEF DESCRIPTION OF THE DRAWINGS

Like reference characters refer to like parts throughout the several views of the drawings.

DESCRIPTION OF THE PREFERRED EMBODIMENTS

Figure 1:
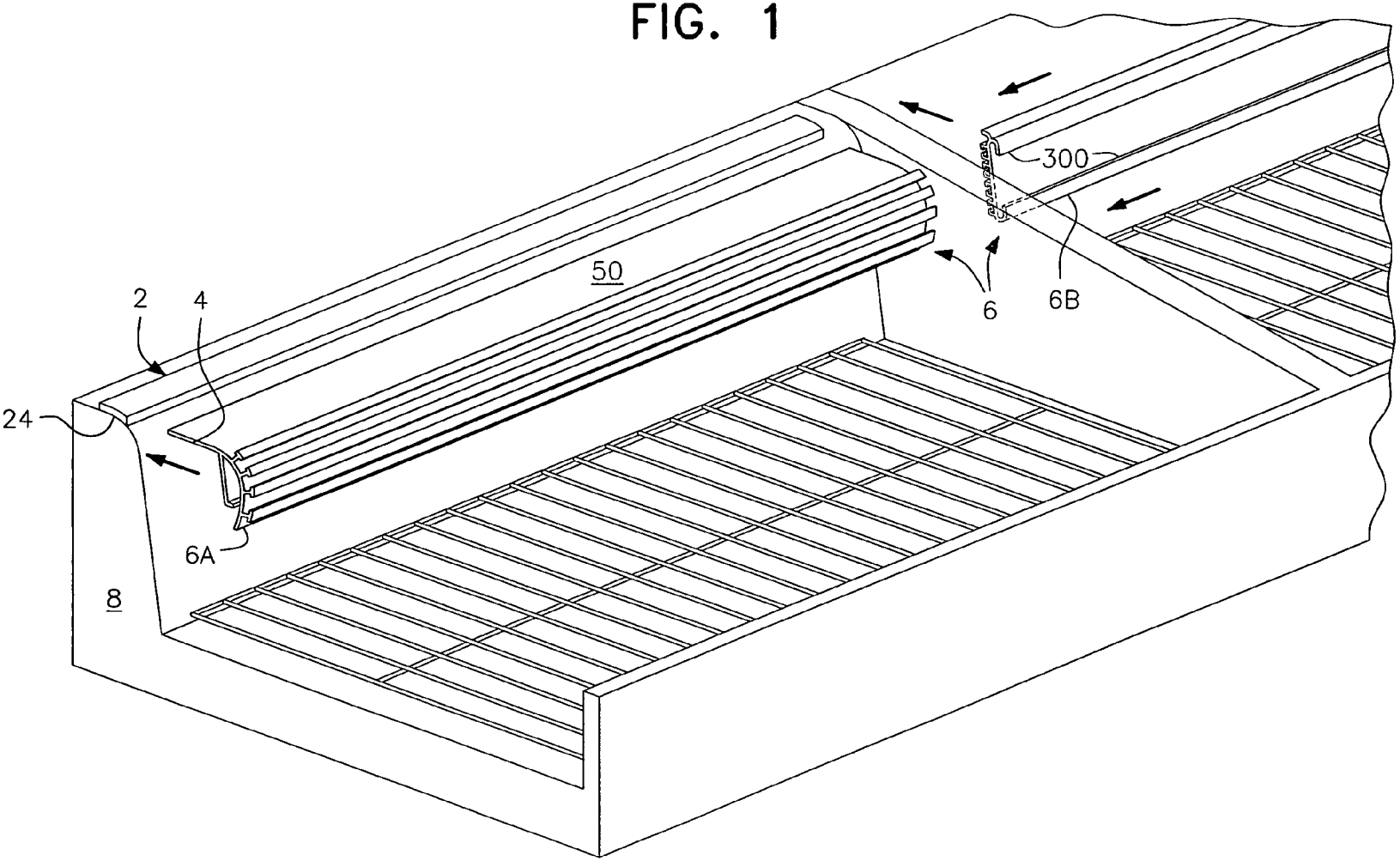
FIG. 1 is a perspective view of a preferred embodiment of the present invention, including the J-strip affixed to the top of a meat display case and the interlocking locking strip associated with an ESL attachment member.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
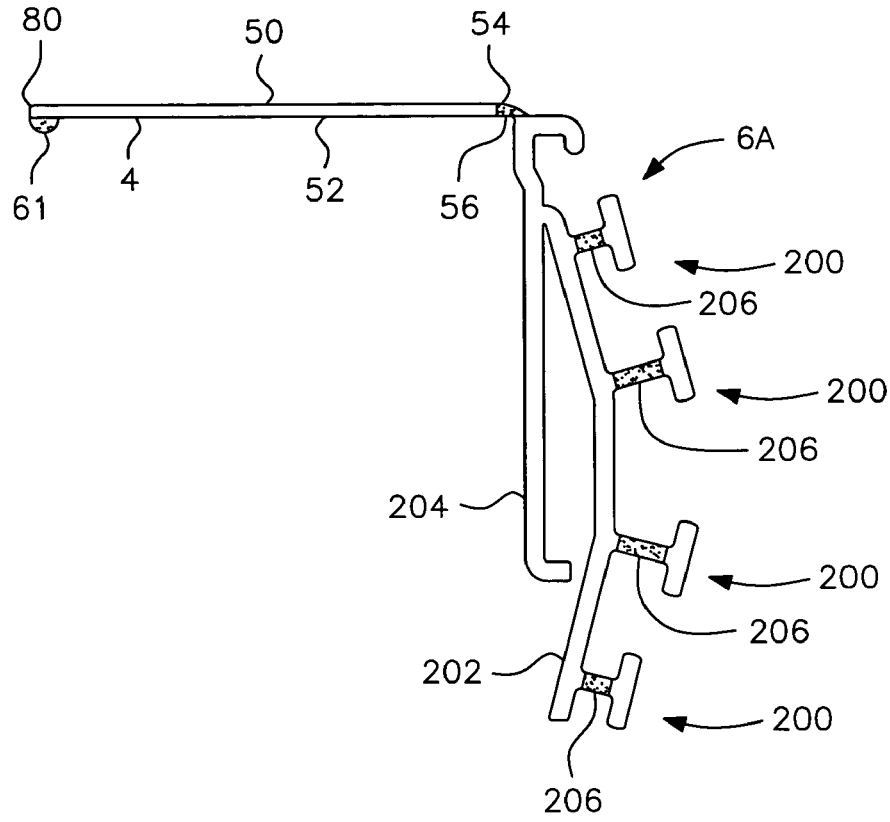
FIG. 2 is a side or edge view of an attachment member for an ESL carrier depicting the novel locking strip associated with the attachment member.
Figure 3:
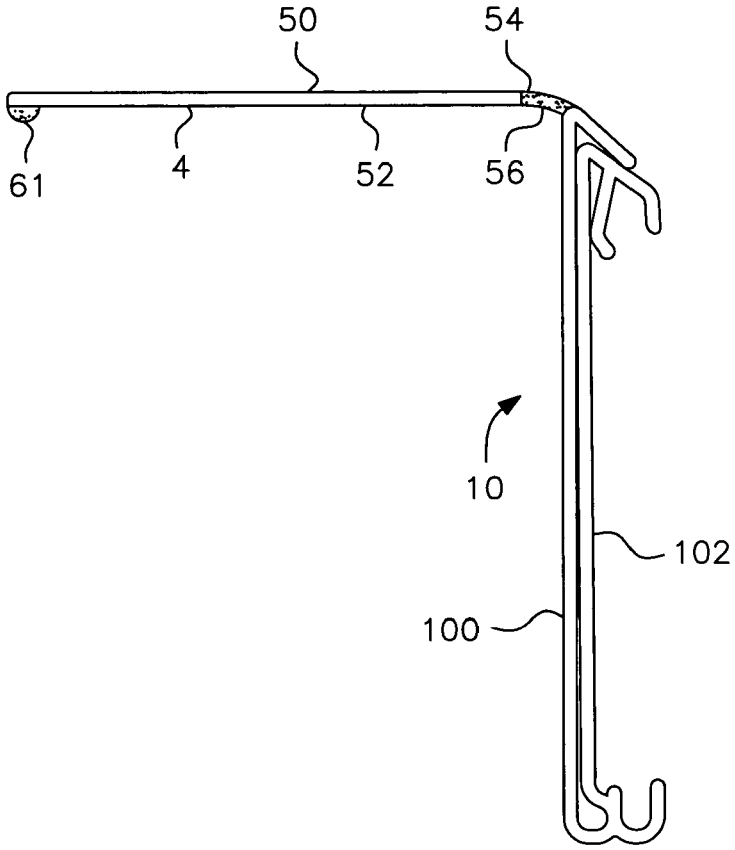
FIG. 3 is a side or edge view of a combined label and sign holder with the locking strip of the present invention.
Figure 4:
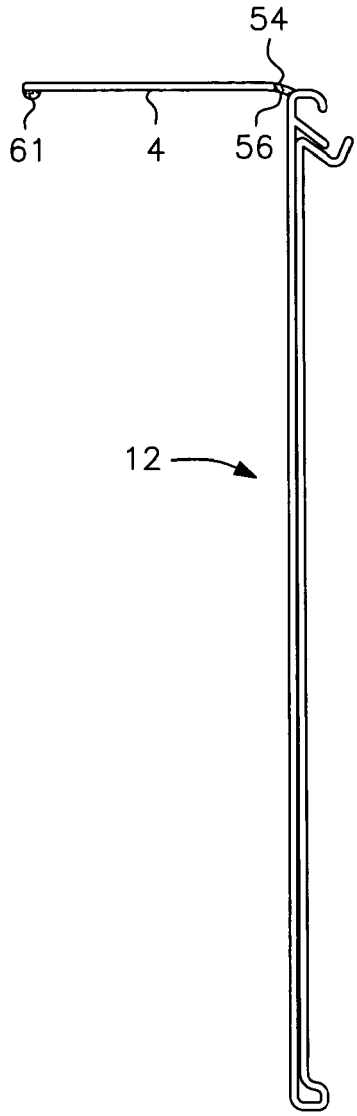
FIG. 4 is a side or edge view of a label holder with the novel locking strip of the present invention.

Referring generally to the drawings, the novel arrangement for mounting or securing a label holder to a merchandising shelf associated with the top of a meat case includes a J-strip support surface mounting element 2 affixed to the support surface and a locking strip 4 that is integral with a label holder. FIGS. 1 and 2 depict the locking strip 4 integral with an attachment member 6*a* of an ESL carrier 6. FIG. 3 depicts the locking strip associated with a combined label/sign holder 10 and FIG. 4 depicts the locking strip integrally associated with a label holder 12. As will be discussed, the locking strip 4 that is integral with each of these "label holders" is inserted into and interlocks within the J-strip 2, which J-strip is shown in side or edge view in FIG. 5. The interengagement between the J-strip 2 and the locking strip 4, with the J-strip affixed to the top of the shelf or case 8, i.e., support surface, is shown in FIG. 6 where the label holder 10 is of the combined label and sign holder embodiment of FIG. 3. It should be apparent that the locking strip 4 can be affixed to any type of label holder, or label/sign holder, or ESL carrier and is engageable with the J-strip 2 in the same manner regardless of the type of label holder utilized.

Figure 5:
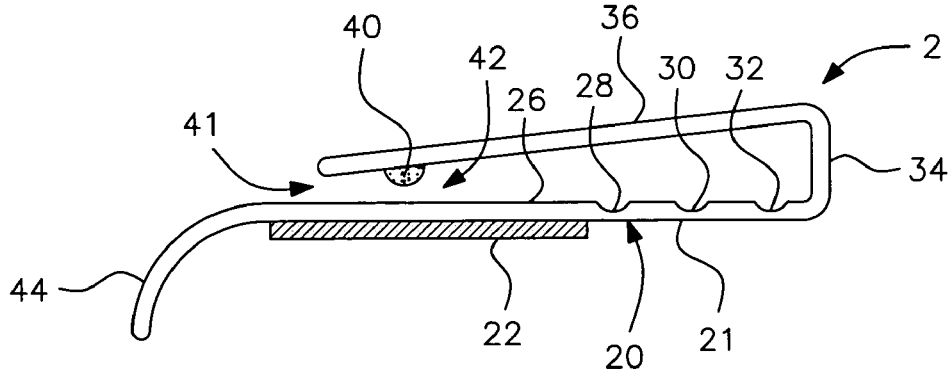
FIG. 5 is a side or edge view of the J-strip that is secured to the supporting surface of a case or shelf.
Figure 6:
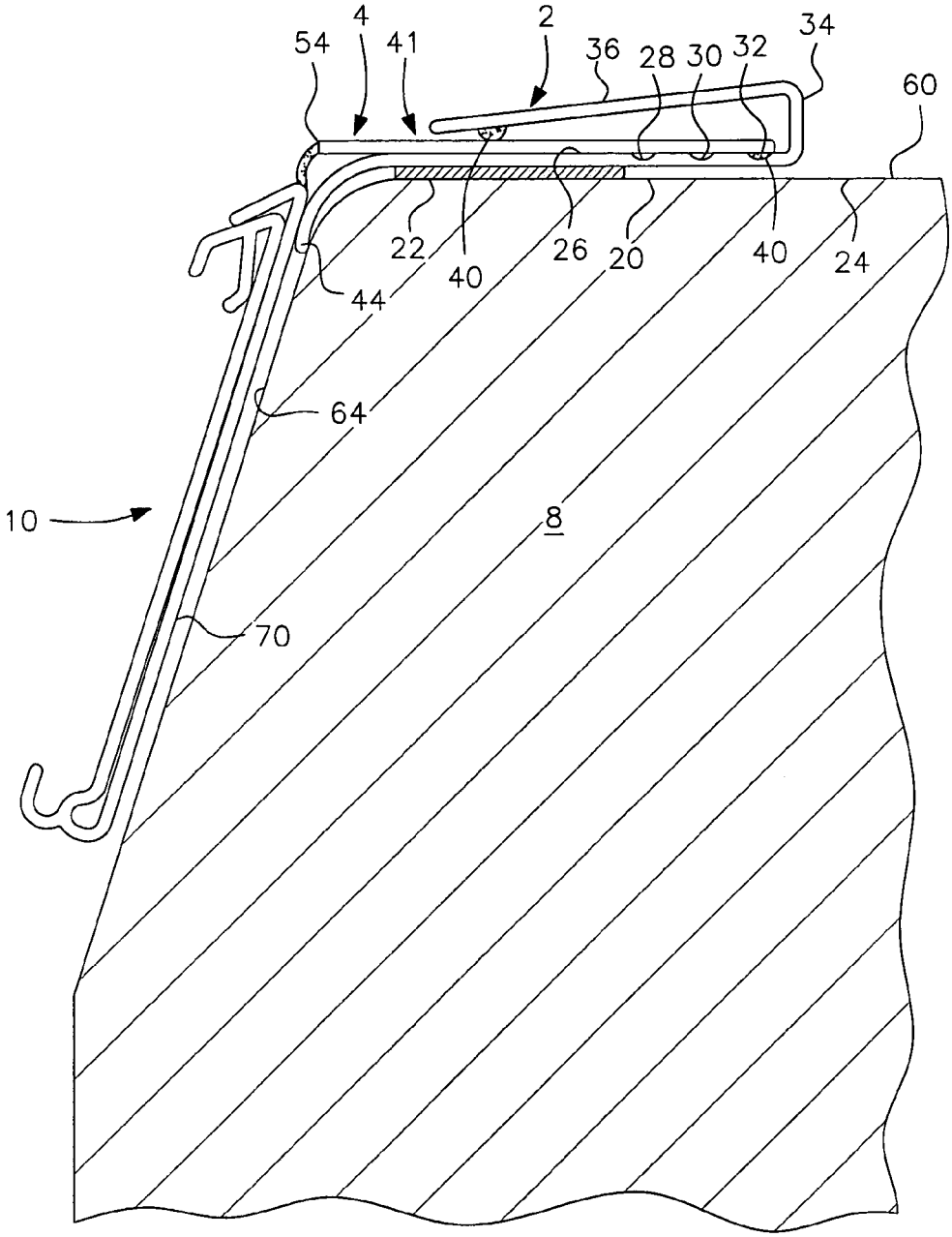
FIG. 6 is a side or edge view showing the locking strip engaged with the J-strip that is affixed to a case or shelf.

With respect to FIGS. 1, 5 and 6, the J-strip 2 is preferably an elongated strip or section, which may be up to 4' or more in length and includes a base member 20 of, preferably rigid PVC material. The base member 20 is substantially flat at its exterior surface 21 to receive a two-sided tape 22 that secures the J-strip to a support surface 24. The tape can be substituted with glue or adhesive or any other similar attachment arrangement that enables the J-strip 2 to be securely retained to the support surface 24 even under conditions where water, at significant pressure, is applied thereto. The base member 20 includes an interior surface 26 that includes three notches or slots 28, 30, 32 that extend preferably along the full length of the base member 20 and receives a flexible PVC bead or edge portion mounted to the locking strip 4 in a manner to be described. The thickness between the base member exterior 21 and its interior surface 26 is relatively thin, for example, approximately 0.028", in a typical embodiment.

At the rearward end of the base member 20 is an upstanding portion 34 lying preferably perpendicular to the base member 20. Extending from this upstanding portion 34 is an overlying substantially planar plate-like member 36 that extends angularly downward in a direction toward the base member 20. The base member 20, upstanding member 34 and overlying plate member 36 are preferably integrally formed of rigid PVC material, although other materials that are substantially rigid may be used. It should also be noted that the overlying plate member 36, at its junction with the upstanding member 34, may provide some flexure.

Forwardly, near the tip of the overlying plate member 36, is a flexible PVC bead or strip 40 that is less rigid than the material that forms the base member, upstanding member and overlying plate member 20, 34, 36, respectively. This flexible PVC bead element 40 is shown as hemispherical in its edge view and this bead grips and assists retention of the locking strip 4 that is inserted into the mouth 41 of the channel 42 that is defined by the base member 20, upstanding member 34 and overlying plate member 36.

At the forward end of the base member 20 is a guide bar 44 that is designed to accommodate itself to the cross-sectional shape of the support surface or shelf, as best shown in FIG. 6. This guide bar 44 is also formed, preferably, of rigid PVC and is extruded to be integral with the base member 20. It is apparent that the shape of the guide bar 44 is especially designed for a specific type of shelf and its configuration may need to change to accommodate different shelf configurations. Alternatively, the guide bar or nose portion 44 of the J-strip 4 may be eliminated entirely.

The J-strip 4 is called a "J-strip" because the base member 20 is slightly longer than the leg or plate member 36, particularly where a guide bar or nose 44 is included. However, the J-strip 2 may be formed where the base member ends to coincide with the tip of its upper member 36, thus being more U-shaped. However, as is defined herein, the J-strip 2 can have substantially equal "legs" 20 and 36. Still further in the preferred embodiment depicted in FIG. 5, the upper leg or plate is angled downwardly from the upstanding member 34 to provide the overall appearance of a biased clip. However, it should be appreciated that the upper leg or plate 36 can be parallel to the base member 20, in which case the upstanding member 34 would be shorter. This would also result in a more U-shaped locking strip, but this arrangement is still defined herein as a J-strip. The principal characteristics or features of the J-strip 2 are the base member 20 with at least one slot or notch, such as notch 32, and an overlying spaced plate member 36 that includes a flexible bead 40, wherein the mouth 41 receives a locking strip or plate 4 to be releasably secured therewithin.

The J-strip 2 of the present invention is intended to receive the locking strip 4 associated with the label holder 6, 10, 12. The locking strip 4 is a substantially planar strip formed preferably of rigid PVC material, preferably of the same material as the J-strip, and of substantially the same thickness as the thickness of the base member 20 or plate member 36. The locking strip 4 is of similar overall length to the length of the section of J-strip 2, as best shown in FIG. 1. The locking strip 4 includes an upper surface 50 and a lower surface 52. The locking strip 4 is hingedly connected to and integral with, the label holder at its end 54. The hinge portion 56 is of a flexible PVC material which allows the label holder 6, 10, 12 to hang relative to the locking strip 4 at various angles depending upon the orientation of the upper surface 60 of the support surface 24 relative to the front surface 64. For example, in FIG. 6, it is seen that the top or upper surface 60 of the support surface 24 is substantially horizontal, whereas the front surface 64 is angled a few degrees off of vertical. This enables the locking strip 4 to be angled at its flexible hinge 56 with respect to the backing surface 70 of the combined label/sign holder 10. It should be appreciated that the upper surface 60 of the support surface 24 may be angled with respect to the horizontal and the front surface 64 could be in a vertical position. Other orientations are possible and the flexible hinge 56 between the locking strip 4 and the attached label holder 10 enables the components to be oriented in various angular arrangements.

At free end 80 of the locking strip 4 is a bead 61 of flexible PVC, similar to the material and shape of bead 40 on the J-strip. Preferably, this bead 61 is at the very end 80 of the locking strip or plate 4 and is intended to be accommodated within one of the slots or channels 28, 30 and 32 of the J-strip 2. In the arrangement of FIG. 6, the flexible PVC bead 61 fits in and is accommodated within the slot or channel 32. It should be appreciated that this bead 61 could be inserted into the J-strip such that it lies within channels 28 or 30 in which case the locking strip 4 is oriented further forward from the support surface, as may be desired.

Regardless of how far the locking strip 4 is inserted within the channel 42 defined by the J-strip 2, the locking strip is additionally retained in the J-strip 2 by the action of the flexible bead 40 acting on the upper surface 50 of the locking strip 4. Thus, the locking strip 4 is retained within the J-strip 2 by the coaction between the J-strip bead 40 in contact with or exerting pressure on the upper surface 50 and the flexible bead 61 of the locking strip 4 engaged within one of the slots or channels 28, 30, 32.

The mouth 41 of the J-strip 2 is sized substantially greater than the thickness of the locking strip 4. Indeed, as best shown in FIG. 6, width or opening between the outermost point of the hemispherical bead 40 to the top surface 26 of the J-strip is substantially equal to or just greater than the width of the locking strip 4 between the surfaces 50 and 52. When the locking strip is inserted into the J-strip channel, there is some give or flexure between the two flexible PVC beads 40 and 60, as well as some flexure at the junction between the overlying plate-like member 36 and the upstanding member 34 of the J-strip.

As is depicted in the drawings, label holders of various types and configurations may be utilized with the novel interlocking J-strip/locking strip arrangement. The combined label and sign holder of FIGS. 3 and 6 is of the type described in U.S. Pat. No. 6,568,112, incorporated herein by reference. This combined label/sign holder includes a back panel 100 and a transparent cover member 102 each having front and rear surfaces and which are flexibly secured to each other at lower edges. The locking strip 4 is hingedly connected with the topmost portion of the rear surface of the back panel 100.

The label holder of FIG. 4 is of the type described in U.S. Pat. No. 5,515,632, incorporated herein by reference. This label holder includes a back member which, at its topmost end, is hingedly connected at 56 to the plate 4 in the same manner as previously described.

The ESL carrier 6 is shown in FIGS. 1 and 2 and is of a configuration as described in pending patent application Ser. No. 10/448,049, also incorporated herein by reference. As is best shown in FIG. 2, the label carrier includes an attachment member 6A which includes an arcuate element 202 with a multiplicity of spaced T-shaped protrusions 200. The arcuate element 202 is affixed to a backing member 204, the upper portion of which is hinged to the locking strip 4 in a manner similar to the other embodiments. The cross bars 200 of the T-shaped protrusions may be flexible PVC and of non-uniform lengths. The attachment member 6A is engaged with the ESL holder 6B, as shown in FIG. 1 which slides within the slots defined by the T-shaped elements, and is engaged to the T-shaped protrusions at various angular orientations as is described in the copending application. The ESL holder 6B includes retaining elements 300 for retaining the ESL (not shown). Further, the ESL holder 6B may include a cover (not shown), but is described in the copending application.

It is thus seen that the novel interlocking arrangement of the J-strip 2 with the locking strip 4 enables the locking strip 4 to be readily and easily detachable from the J-strip 2 with the label holder, including an ESL carrier 6, to be removed without removing the holder 6B from the attachment member 6A. This provides a quick and reliable disconnect to enable the meat case to be washed or hosed down without adversely affecting the electronics of the ESL. Similarly, labels and label sign holders can be easily removed and only the J-strip 2 remains in the region subject to cleaning.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. An attachment arrangement for attaching a label holder to a merchandise supporting surface comprising an elongated channel securable to the supporting surface and a locking strip integral with the label holder;

said elongated channel including a base member affixable to the supporting surface, an upstanding member extending upward from the base member, and a clip plate extending angularly downward from the upstanding member in a direction toward the base member to define a mouth between the clip plate and the base member, the interior of said elongated channel including at least one elongated slot disposed on said base member interior and an elongated bead disposed on the interior of the clip plate adjacent said mouth;

said locking strip integral with the label holder insertable within the mouth of the channel, and including a substantially planar member having an upper surface and a lower surface, said lower surface including a flexible bead engageable within said elongated slot with said upper surface engaged by said elongated bead of said channel to retain said locking strip within said elongated channel.

2. The attachment arrangement of claim 1 wherein the label holder is an ESL carrier.

3. The attachment arrangement of claim 1, wherein said elongated channel is of rigid PVC material and said elongated bead disposed on the interior of the clip plate of said elongated channel is of a co-extruded flexible PVC material.

4. The attachment arrangement of claim 3, wherein said elongated slot on said base member is disposed closer to said upstanding member than to the mouth.

5. The attachment arrangement of claim 4, wherein three elongated slots are disposed on said base member.

6. The attachment arrangement of claim 1, further comprising a guide bar integrally formed with said base member.

7. The attachment arrangement of claim 1, wherein said substantially planar member of said locking strip is integrally co-extruded with said label holder.

8. The attachment arrangement of claim 7, wherein said substantially planar member is of rigid PVC material and includes a flexible PVC hinge portion integral with said label holder.

9. The attachment arrangement of claim 8, wherein said label holder is an ESL carrier.

10. A combined J-strip and locking strip attachment arrangement having a label holder integrally formed therewith and attachable to a merchandise supporting surface, comprising a J-strip comprising a base member, an upstanding member, and a plate member overlying said base member, and defining an opening between said base member and plate member, an elongated bead disposed integrally with said overlying plate member adjacent said opening, said bead formed of flexible PVC material, and at least one elongated slot disposed on said base member within the interior of the J-strip and adjacent the upstanding member, a locking strip comprising a substantially planar member integral with a label holder, said planar member having an upper surface and a lower surface, said lower surface including a flexible bead that is engageable with said elongated slot of said J-strip when said locking strip is inserted within the interior of said J-strip, and wherein said elongated bead disposed on the overlying plate member provides a biasing force on the upper surface of said locking strip whereby the interengagement between the flexible bead and said elongated slot and a compressive force of said elongated bead against the upper surface of the locking strip serves to retain the locking strip within the J-strip.

11. The combination of claim 10, wherein said label holder is integrally formed with said locking strip by a co-extruded flexible hinge.

12. The combination of claim 11, further comprising a curved guide bar formed integrally with the base member.

* * * * *